US012365501B2

(12) United States Patent
Missoum et al.

(10) Patent No.: US 12,365,501 B2
(45) Date of Patent: Jul. 22, 2025

(54) PROCESS FOR THE PRODUCTION OF A CONTAINER FOR THE PREPARATION OF A BEVERAGE IN A BEVERAGE PREPARATION DEVICE AND A CONTAINER OBTAINED BY SAID PROCESS

(71) Applicant: SOCIETE DES PRODUITS NESTLE S.A., Vevey (CH)

(72) Inventors: Karim Missoum, Pusignan (FR); Nicola Galaffu, Ornex (FR)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 18/711,166

(22) PCT Filed: Nov. 16, 2022

(86) PCT No.: PCT/EP2022/082071
§ 371 (c)(1),
(2) Date: May 17, 2024

(87) PCT Pub. No.: WO2023/088934
PCT Pub. Date: May 25, 2023

(65) Prior Publication Data

US 2025/0026518 A1 Jan. 23, 2025

(30) Foreign Application Priority Data

Nov. 19, 2021 (EP) ..... 21209165

(51) Int. Cl.
*B65B 51/00* (2006.01)
*B65B 29/02* (2006.01)
*B65B 51/32* (2006.01)

(52) U.S. Cl.
CPC ..... *B65B 29/025* (2017.08); *B65B 51/32* (2013.01)

(58) Field of Classification Search
CPC ..... B65B 29/025; B65B 51/32; B65B 29/02; B65B 29/022; B65B 1/04; B65B 29/028;
(Continued)

(56) References Cited

U.S. PATENT DOCUMENTS 4,055,109 A 10/1977 Kan
10,189,622 B2 1/2019 Scrivani et al.
(Continued)

FOREIGN PATENT DOCUMENTS

KR 20190006309 1/2019
WO 2013046149 4/2013
WO 2020234793 11/2020

*Primary Examiner* — Jacob A Smith
(74) *Attorney, Agent, or Firm* — K&L Gates LLP

(57) ABSTRACT

The present invention concerns a process for producing a container for the preparation of a beverage in a beverage preparation device, comprising the steps of: a. providing a water injection wall (3) of said, b. providing a beverage delivery wall (4) of said container, wherein at least one, preferably both, of said injection and delivery walls (3, 4) has a cup shape, c. placing a beverage ingredient body in said at least one cup shaped wall (4), d. sealing together edge portions (3A, 4A) of said injection and delivery walls (4, 3) in a sealing station, such as to form a chamber (1), wherein said sealing station comprise a housing element having a housing temperature (Th), wherein said body (2) is shaped and dimensioned such as not to completely fill said chamber (1), said process being characterized in that, after the sealing step, the container is cooled to a cooling temperature (Tc) being either: —at least 15° C. lower than the temperature of the housing, or—comprised between −10° C. and +25° C.

9 Claims, 2 Drawing Sheets

(58) Field of Classification Search
CPC .. B65B 51/10; B65D 85/804; B65D 85/8043; B65D 85/8046; B65D 85/8055; B32B 27/10
USPC ..... 53/559
See application file for complete search history.

(56) References Cited

U.S. PATENT DOCUMENTS

| | | | | |
|---|---|---|---|---|
| 2007/0259139 | A1* | 11/2007 | Furneaux ..... | B65D 85/8043 428/34.3 |
| 2009/0197750 | A1 | 8/2009 | Beckmann et al. | |
| 2014/0224130 | A1* | 8/2014 | Castellani ..... | A47J 31/4492 426/77 |

* cited by examiner

PROCESS FOR THE PRODUCTION OF A CONTAINER FOR THE PREPARATION OF A BEVERAGE IN A BEVERAGE PREPARATION DEVICE AND A CONTAINER OBTAINED BY SAID PROCESS

CROSS REFERENCE TO RELATED APPLICATIONS

The present application is a National Stage of International Application No. PCT/EP2022/082071, filed on Nov. 16, 2022, which claims priority to European Patent Application No. 21209165.6, filed on Nov. 19, 2021, the entire contents of which are being incorporated herein by reference.

FIELD OF THE INVENTION

The present invention concerns a process for the production of a container for the preparation of a beverage in a beverage preparation device, and a container obtained by said process.

BACKGROUND OF THE INVENTION

It is known to prepare beverages by using a pod containing an ingredient, in particular ground coffee, in a beverage preparation device. The known pods have a chamber, usually made by superimposing two cup shaped bodies arranged upside down with respect to each other and welded together along respective edges (as shown in FIGS. 1 and 3). The cup shaped bodies are generally—but not absolutely necessarily—identical. The known pods usually comprise an injection wall, through which water is to be introduced in the pod chamber, and which is configured to be punctured by an injection member of the beverage preparation device for circulating a fluid under pressure inside said chamber, and a beverage delivery wall, through which the beverage is to be dispensed, and which is configured to be opened upon interaction with opening elements of the beverage preparation device.

Before sealing together the two cup shaped bodies, a beverage ingredient is placed in the cup shaped delivery wall. The beverage ingredient is usually a body formed by a compacted ingredient, having a three-dimensional shape and being dimensioned such as not to completely fill the chamber delimited by the injection and delivery walls and in such a way that a rather large empty space is provided in the chamber between said body and the internal surfaces of the injection and delivery walls (as shown in FIG. 3). In the known pods the beverage ingredient body is not in contact with the entire internal surfaces of the shells, but usually it is in contact only with a limited central portion of the delivery wall.

Following an eco-responsible approach, some of the existing pods are made of paper. In such paper pods, it happens that during extraction, in addition to the openings due to the interaction of delivery wall with the beverage preparation device, cracks are formed in addition to the desired openings for the outflow of the beverage. These cracks are unwanted, because they negatively affect a correct beverage preparation, and also because from these cracks the beverage ingredient, for example ground coffee, flows out of the pod and inside a user cup.

The object of the present invention is to provide a process for the production of a container for the preparation of a beverage and a container obtained by said process which obviate the aforementioned drawbacks of existing container. In particular, it is an object of the present invention to provide a process for the production of a container for the preparation of a beverage and a container obtained by said process which improve the opening of the delivery wall of the container, avoiding the formation of unwanted cracks in said wall.

SUMMARY OF THE INVENTION

The invention as claimed in claim 1 is a process for producing a container for the preparation of a beverage in a beverage preparation device, comprising the steps of:

a. providing an injection wall of said container, comprising a paper layer through which water is to be introduced in the container, wherein said injection wall is able to be punctured by an injection member of the beverage preparation device for circulating water under pressure inside said container, b. providing a beverage delivery wall of said container, comprising a paper layer through which the beverage is to be dispensed out of the container, wherein said delivery wall is able to be opened by an opening member of the beverage preparation device when the pressure inside said container presses said delivery wall against said opening member, wherein at least one, preferably both, of said injection and delivery walls has a cup shape, c. placing a beverage ingredient in said at least one cup shaped wall, wherein said beverage ingredient is a body formed by a compacted beverage ingredient, d. sealing together edge portions of said injection and delivery walls in a sealing station, such as to form a chamber in which said body formed by a compacted beverage ingredient is stored, wherein said sealing station comprise a housing element for housing at least partially said injection and/or delivery walls and wherein said housing element at the beginning of the sealing has a housing temperature, and wherein said body is shaped and dimensioned such as not to completely fill said chamber.

According to the invention, after the sealing step, the container is cooled to a cooling temperature Tc.

According to the invention, the characteristic of the cooling temperature Tc is that it is either:

at least 15° C. lower than the temperature of the housing, or said cooling temperature is comprised between −10° C. and +25° C.

The inventors were surprised to discover that the cooling of the container reduces the space in the chamber (i.e. headspace) that is not filled by the compacted ingredient body, and increases at least the area of the internal surface of the delivery wall which adheres to the body of the compacted beverage ingredient.

Preferably, the duration of the cooling step is at least 0.5 second, and preferably at least 1 second, more preferably for a time period comprised between 1 second and 5 seconds.

Preferably, the housing temperature is between 40° C. and 100° C., more preferably between 60° C. and 70° C.

Preferably, the container is cooled with a cooling gas, preferably air, which has, preferably, a pressure of at least 0.5 bar, more preferably with a gas pressure comprised between 1 bar and 6 bar.

Preferably, the cooling step starts within 0.1 second and 60. seconds, preferably within 0.1 second and 10 seconds, from the end of the sealing step The present invention also relates to a container for the preparation of a beverage in a beverage preparation device, obtained by a process as described before, comprising a chamber in which a beverage ingredient is stored.

The chamber is delimited by:

an injection wall, through which a fluid, preferably water, is to be introduced in the container, wherein said injection wall is configured to be punctured by an injection member of the beverage preparation device for circulating said fluid under pressure inside said chamber, and a beverage delivery wall, through which the beverage is to be dispensed out of the container, wherein said beverage delivery wall is configured to be opened upon interaction with opening elements of the beverage preparation device under the effect of rising pressure of said fluid being injected into said chamber.

The injection and the delivery walls comprise sealing portions for sealingly connecting said injection and the delivery walls together.

The injection and delivery walls form an oxygen barrier for the beverage ingredient stored in said chamber.

The beverage ingredient is a body formed by a compacted ingredient, having a three-dimensional shape and being dimensioned such as not to completely fill the chamber, and in such a way that at least one empty space is provided in the chamber between said body and the internal surfaces of the injection and delivery walls.

The injection and delivery walls comprise a paper layer.

According to the invention the empty space inside said chamber is less than 5% of the total volume of said chamber, preferably is less than 3%; and the inner surface of at least said delivery wall and preferably also the inner surface of the injection wall, is continuously in contact with the outer surface of the beverage ingredient body except for a terminal portion of said injection and delivery walls located at the sealing portions.

Preferably, the paper layer of the injection and delivery walls has at least one of following features:

i) it is made of a sulfurized paper, having intrinsic oxygen barrier features;

ii) it is a formable paper layer, which can be stretched and deformed for obtaining a requested shape, preferably a cup shape, for the injection and delivery walls;

iii) it has a weight comprised between 50 g/m$^2$ and 200 g/m$^2$, more preferably comprised between 70 g/m$^2$ and 150 g/m$^2$.

Preferably, the injection and the delivery walls have a cup shape, which is preferably revolutionary symmetrical, the injection and delivery walls have the same shape and dimensions, and that the beverage ingredient body has a three-dimensional shape, substantially identical to the shape of the chamber delimited by the injection and the delivery walls.

Preferably but not exclusively, the container of the invention is a single use coffee pod.

According to the invention, the use of a container as described before in a beverage preparation device is also disclosed.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
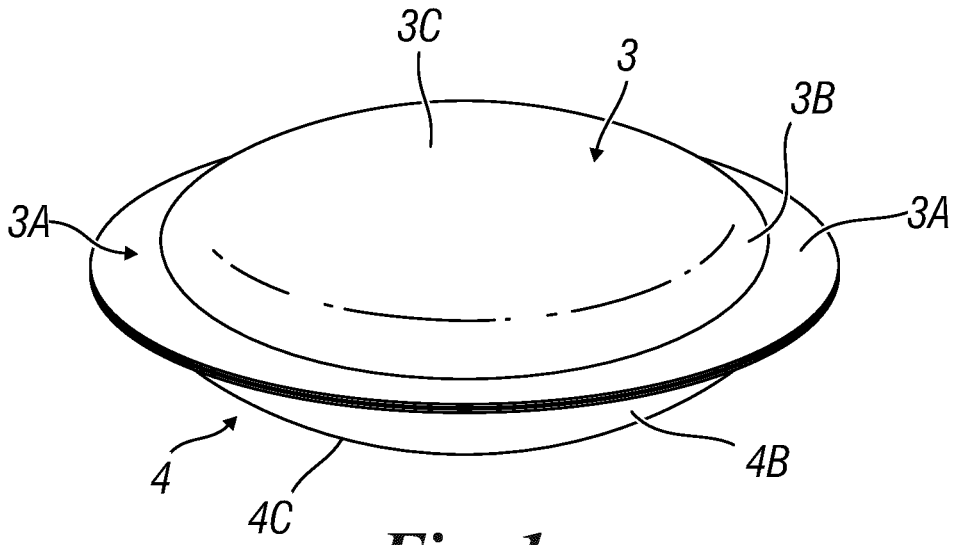
FIG. 1 is a schematic perspective view of a container usual for the skilled person.

The figures illustrate a container for use in a beverage preparation device (not shown but usual for the skilled person), comprising a chamber 1 in which a beverage ingredient 2 is stored. The chamber 1 is delimited by an injection wall 3, through which a fluid, preferably water, is to be introduced in the container, and which is configured to be punctured by an injection member of the beverage preparation device for circulating said fluid under pressure inside said chamber 1, and by a beverage delivery wall 4 of the container, through which the beverage is to be dispensed, and which is configured to be opened upon interaction with opening elements of the beverage preparation device (e.g. a puncturing or tearing interaction) under the effect of rising pressure of said fluid being injected into said chamber 1.

The injection and delivery walls 3, 4 comprise sealing portions 3A, 4A for sealingly connecting said walls 3, 4 together.

The injection and delivery walls 3, 4 form an oxygen barrier for the beverage ingredient 2 stored in the chamber 1.

The beverage ingredient 2 is a body formed by a compacted ingredient, having a three-dimensional shape and being shaped and dimensioned such as not to completely fill the chamber 1. Therefore, in the chamber 1 there is at least one empty space 6 (FIG. 4) between the body 2 of the compacted ingredient and the internal surfaces of the injection and delivery walls 3, 4.

According to the invention, the injection and delivery walls 3, 4 comprise a paper layer.

According to the invention, the empty space 6 inside said chamber 1 is less than 5% of the total volume of said chamber 1, preferably less than 3%.

According to the invention, the inner surface of at least the delivery wall 4, and preferably also the inner surface of the injection wall 3, is continuously in contact with the outer surface of the beverage ingredient body 2, except for a short terminal portion 4F, 3F of said walls 3, 4 located at the sealing portions 3A, 4A.

This short terminal portion 4F, 3F of the delivery and injection walls 4, 3 preferably has a dimension between 1 mm and 10 mm.

Thanks to the facts that the empty space 6 in the chamber 1 is very limited, that this empty space 6 is preferably provided substantially only at the portions 3A, 4A, and that the delivery wall 4 is almost entirely in contact with the beverage ingredient 2 (which forms a sort of "cushion"), it has been verified that in the delivery wall 4 no cracks are formed during the beverage outflow, and that the beverage flows out only through the openings which are formed by the interaction of the delivery wall 4 with the opening elements of the beverage preparation device.

Figure 3:
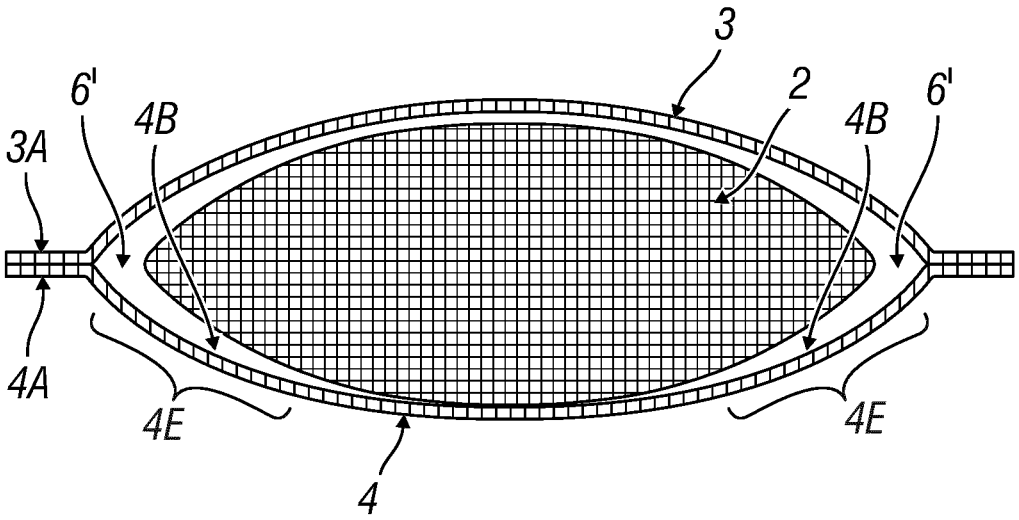
FIG. 3 is a schematic cut view of the container of FIG. 1.
Figure 4:
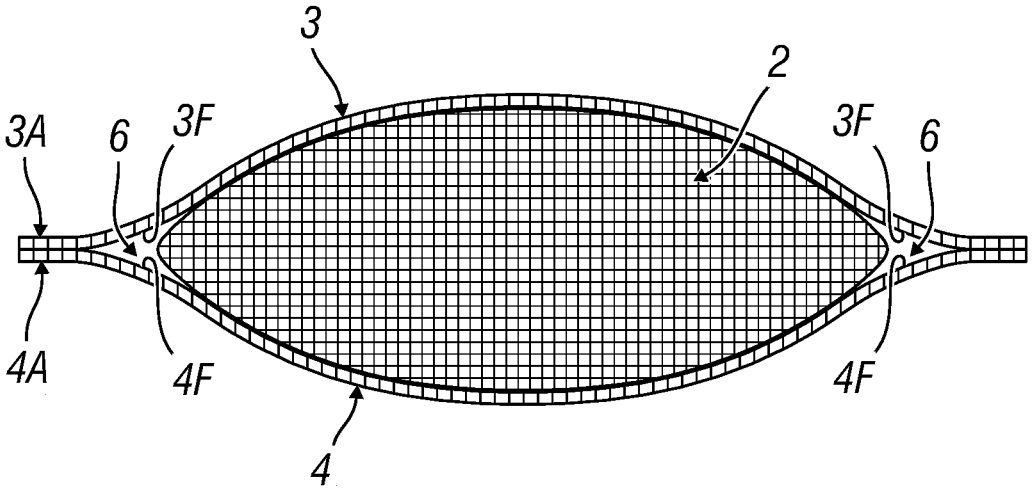
FIG. 4 is a schematic cut view of a container according to the invention.

It is to be noted that, as shown in FIG. 3, in known containers of the aforementioned type (and having injection and delivery walls 3, 4 and a body 2 with the same dimensions of the walls and body of the container according to the invention, shown in FIG. 4), the empty space 6' not filled by the body 2 in the chamber 1 delimited by the injection and delivery walls 3, 4 is much greater than that present in the container according to the invention (shown in FIG. 4). Moreover, in known containers the delivery wall 4 has large portions 4E which are not in contact with the body 2 of the compacted ingredient. As shown in FIG. 3, the empty portions 6' are not only located at the sealing portions 4A, 3A (as in the container according to the invention and shown in FIG. 4), but are also located at the lateral wall portion 4B of the delivery wall 4, that is precisely in the area of the delivery wall 4 where the unwanted cracks are formed during the outflow of the beverage.

Preferably, the injection and the delivery walls 3, 4 have a cup shape, which is preferably revolutionary symmetrical.

Preferably, the injection and the delivery walls 3, 4 have a circular cross section increasing towards the sealing portions 3A, 4A.

The injection and the delivery walls 3, 4 comprise a base wall portion 3C, 4C, a lateral wall portion 3B, 4B and the sealing portion 3A, 4A, which is preferably flat.

Preferably, the injection and the delivery walls 3, 4 have the same shape and dimensions.

Preferably, the compacted ingredient 2 has a tridimensionality shape, substantially identical to the shape of the chamber 1. For example, as shown in FIGS. 3 and 4, the compacted ingredient 2 has the shape of a disc having a thickness decreasing from the centre towards its outer edge. As already stated above, this compacted ingredient 2 does not completely fill the chamber 1.

The fact that the body 2 of the compacted ingredient 2 does not have exactly the same shape and dimensions as the chamber 1 delimited by the injection and delivery walls 3, 4 allows to speed up the automatic operations for the production of the container, since the operations necessary to insert the compacted ingredient 2 in the container and to form the chamber 1 of the container by sealing together the injection and delivery walls 3, 4 are extremely simplified.

Figure 2:
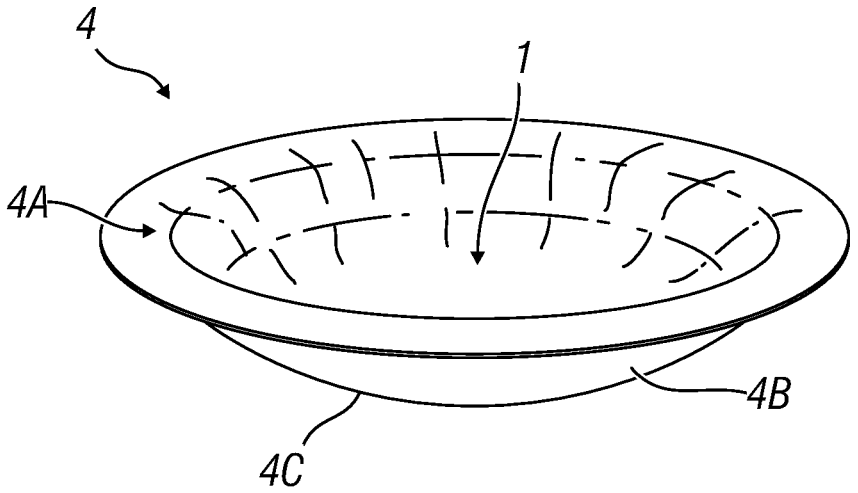
FIG. 2 is a schematic perspective view of one of the two identical walls of the container shown in FIG. 1.

Preferably, the paper layer of the injection and delivery walls 3, 4 is a formable paper layer. As usual for the skilled person, the injection and delivery walls 3, 4 are preferably formed starting from a blank of paper, which is stretched and given the requested shape, preferably a cup shape, as shown in FIG. 2.

Preferably, the paper layer of the injection and delivery walls 3, 4 is a sulfurized paper, that is, a paper having intrinsic oxygen barrier features. This type of paper is preferred, since an additional oxygen barrier liner does not need to be attached to it.

Preferably, the formable paper layer of the injection and delivery walls 3, 4 has a weight comprised between 50 $g/m^2$ and 200 $g/m^2$, more preferably comprised between 70 $g/m^2$ and 150 $g/m^2$.

If the paper layer of the injection and delivery walls 3, 4 has not intrinsic oxygen barrier features, a usual oxygen barrier liner is attached to this paper layer.

This oxygen barrier liner is made of a known mono- or multi-layer polymeric liner, comprising for example a polymer of fossil or non-fossil origin, or a biosourced polymer, and is preferably attached to the inner surface of the injection and delivery walls 3, 4.

A preferred multilayer barrier liner comprises a core layer having oxygen and/or moisture barrier properties, surrounded by a sealing layer for sealing said barrier liner to the injection and delivery walls 3, 4.

The oxygen barrier liner, by way of non-limiting examples, comprises one or more of following layers:

an outermost polymeric layer comprising a biodegradable polymer selected within the list of: polybutylene succinate (PBSA/bioPBS/PBS), polybutylene adipate terephthalate (PBAT), starch, cellulose derivates, polylactic acid (PLA), polyhydroxyalcanoates (PHA), or a combination thereof;

a first tie layer comprising a biodegradable modified or functionalized polyolefin;

a barrier layer comprising a polymer selected within the list of: butenediol vinyl alcohol copolymer (BVOH), polyvinyl alcohol (PVOH) or a combination thereof;

a second tie layer comprising a biodegradable modified or functionalized polyolefin;

an innermost polymeric layer comprising a biodegradable polymer selected within the list of: polybutylene succinate (PBSA/bioPBS/PBS), polybutylene adipate terephthalate (PBAT), starch, cellulose derivates, polylactic acid (PLA), polyhydroxyalcanoates (PHA) or a combination thereof.

Preferably, the barrier to oxygen for the injection and the delivery walls 3, 4 is selected to provide a sufficient shelf life depending on the nature of the beverage ingredient. For coffee, for example, the shelf life expected may be of 12 months.

Preferably, the injection and delivery walls 3, 4 of the container are made of home compostable materials. The containers according to the invention are normally meant to be recycled in recycling processes that are organized at official recycling facilities according to national regulations (for instance in paper recycling streams, or in general garbage recycling or treatment streams). However, in case the container is placed in nature, in a household compostable waste or in a landfill, said containers are designed with materials that are naturally ready to be degraded by bacteria and in conditions of temperature and humidity that are naturally present in nature. In this way, it is ensured that such containers will not stay in nature and will naturally disappear within a short period of time (a few weeks in principle) within the conditions defined by home composability standards. More precisely, home composability is now well defined on a national level and mainly based on international standard EN 13432; therefore, they do not require to be further defined in-depth in the present specification. Materials or products compliant with these standards can be recognized by a conformity mark stating their home composability. Some examples of home composability certifications at a national level include, but are not limited to, the following. The certifier TUV AUSTRIA BELGIUM offers such a home composability certification scheme, and DIN CERTCO offers a certification for home composability according to the Australian standard AS 5810. Italy has a national standard for composting at ambient temperature, UNI 11183:2006. In November 2015, the French Standard "NF T 51-800 Plastics—Specifications for plastics suitable for home composting" was introduced. This standard is covered in the DIN CERTCO scheme.

The preparation of the beverage is obtained by mixing of the fluid substance with an ingredient contained in the container. Preferably, the ingredients are chosen within the list of roast and ground coffee, compacted or not, soluble powder coffee or leaf tea. Dairy ingredients (e.g., milk or creamer) could also be provided, as well as chocolate, fruit juices, soups, vegetable juices, bouillons, smoothies, purees, coulis, creams, chicory, barley, culinary aid, soup ingredient, infant formula or a combination thereof, in powdered soluble form, liquid concentrated form having various viscosities or in gel form.

Most preferably, the beverage ingredients are roast and ground coffee.

The container of the invention may typically interact with a beverage and/or food preparation device, such as by being fed with a diluent (e.g., hot, cold or ambient water) in the container; such diluent mixes, or interacts otherwise, with the beverage ingredients. With the expression "mixing of the diluent with the beverage ingredient(s)" it should be intended that all the ingredients contained in the container are in a form which is compatible with a generic mixing operation (dissolution, extraction or infusion) with the diluent to obtain the beverage product. Devices of this type are for example those used for the extraction of "Nespresso Pro" ® professional pods.

Preferably, the chamber 1 delimited by the injection and the delivery walls 3, 4 is essentially oxygen-free and the empty space inside the container is saturated with an inert gas such as nitrogen, carbon oxide and combinations thereof. Preferably, the container has an internal pressure of gas above atmospheric pressure, due to the gas contained in the coffee and emanating in the cavity after sealing, such as carbon oxide and dioxide.

A further aspect of the present invention relates to a process for producing the container for the preparation of a beverage in a beverage preparation device described above.

This process comprises the steps of:

providing an injection wall 3 comprising a paper layer, through which water is to be introduced in the container, and wherein said injection wall 3 is able to be punctured by an injection member of the beverage preparation device for circulating water under pressure inside said container, and providing a beverage delivery wall 4 comprising a paper layer, through which the beverage is to be dispensed out of the container, and wherein said delivery wall 4 is able to be opened by an opening member of the beverage preparation device when the pressure inside said container presses said delivery wall 4 against said opening member, wherein at least one of said injection and delivery walls 3, 4 has a cup shape.

The process further comprises a step wherein a beverage ingredient 2 is placed in the at least one cup shaped wall 4, and wherein said beverage ingredient 2 is a body formed by a compacted ingredient.

The process further comprises a sealing step wherein sealing portions 3A, 4A of said injection and delivery walls 3, 4 are sealed in a sealing station, such as to form a chamber 1 in which said body 2 formed by a compacted ingredient is stored.

The sealing station comprise a housing element for housing at least partially said sealing portions 3A, 4A.

The housing element at the beginning of the sealing has a housing temperature Th.

The sealing body 2 is configured such as not to completely fill said chamber 1.

According to the invention, after the sealing step the container is cooled at a cooling temperature.

According to the invention, the difference between the housing temperature (Th) and the cooling temperature (Tc) is 15° C. or more (said cooling temperature being of course lower than the temperature of the housing), or alternatively, the cooling temperature (Tc) is chosen between −10° C. and +25° C.

It has been experimentally verified that this cooling step after the sealing step reduces the space not filled by the body 2 in the chamber 1 and increases the area of the internal surface at least of the delivery wall 4 which adheres to the body 2 of the compacted beverage ingredient. In particular, the cooling step causes an adhesion of the injection and the delivery walls 3, 4 to the body 2 of the compacted ingredient, which reduces the empty space in the chamber 1 not filled by the body 2.

Preferably, the cooling step has a duration of at least 0.5 second, preferably of at least 1 second, more preferably for a time period comprised between 1 second and 5 seconds.

As discussed in more detail below preferably the housing temperature (Th) is comprised between 40° C. and 100° C.

FIG. 3 shows a container after the sealing step and before the cooling step, and FIG. 4 shows the same container after the cooling step. As may be seen by comparing these two figures, the empty space 6' of the container before the cooling step (illustrated in FIG. 3) is much greater than the empty space 6 present in the container after the cooling step (depicted in FIG. 4). In the container before the cooling step (FIG. 3) the delivery wall 4 has a large portion 4E of its lateral wall 4B which is not in contact with the body 2 of the compacted ingredient. The empty portions 6' of the container before the cooling step (FIG. 3) are not only located at the sealing portions 4A, 3A of the delivery and injection walls, but are also located at the lateral wall portion 4B of the delivery wall 4.

As depicted in FIG. 4, after the cooling step the injection and delivery walls 3, 4 are almost continuously in contact with the outer surfaces of the body 2 of compacted ingredient (no head space is present), except for an empty space 6 located only at the sealing portions 3A, 4A of the injection and delivery walls 3, 4.

As already stated above, thanks to the fact that the empty space in the chamber 1 is very limited, that this empty space is preferably provided substantially only at the sealing portions 3A, 4A, and that the delivery wall 4 is almost entirely in contact with the beverage ingredient (which forms a sort of "cushion"), it has been verified that in the delivery wall 4 no cracks are formed during the beverage outflow, and that the beverage flows out only through the openings which are formed by the interaction of the delivery wall 4 with the opening elements of the beverage preparation device.

Preferably, after the cooling step, the empty space inside the chamber 1 delimited by the injection and delivery walls, is less than 5% of the total volume of said chamber 1, preferably less than 3%, and the inner surface of at least the delivery wall 4 and preferably also the inner surfaces of the injection wall 3, is continuously in contact with the outer surface of the beverage ingredient body 2 except for a terminal portion 4F, 3F of said walls 3, 4, located at the sealing portion 3A, 4A of said walls 3, 4.

Preferably the container is cooled with a cooling gas, for example air, which has, preferably, a pressure of at least 0.5 bar, more preferably with a gas pressure comprised between 1 bar and 6 bar. Other alternatives for cooling may be envisaged, for instance using other types of fluid than a gas (e.g. a cooling liquid that is circulated onto the surface of the sealed pod). In another alternative, the pod is rapidly moved from the sealing housing towards another location of the manufacturing line, which can be e.g. a cooling chamber through which the pod is circulated, said chamber being cooled such that the atmosphere therein has a temperature maintained at a level which corresponds to the cooling temperature (Tc) provided in the present specification.

As stated before, the injection and the delivery walls 3, 4 have preferably the same cup shape and dimensions and are made by forming a paper layer. As usual for the skilled person, the injection and delivery walls 3, 4 are formed starting from a blank of paper, which is stretched and given the requested shape, preferably a cup shape, as illustrated in FIG. 2.

As stated before, preferably the paper layer of the injection and delivery walls 3, 4 is a sulfurized paper, that is a paper having intrinsic oxygen barrier features. This type of paper is preferred since an additional oxygen barrier liner does not need to be attached to it.

As stated before, preferably the formable paper layer of the injection and delivery walls 3, 4 has a weight comprised between 50 $g/m^2$ and 200 $g/m^2$, more preferably comprised between 70 $g/m^2$ and 150 $g/m^2$.

As stated before, if the paper layer of the injection and delivery walls 3, 4 has not intrinsic oxygen barrier features, a usual oxygen barrier liner is attached to this paper layer.

All the steps and devices necessary for producing the container, with the exception of the final cooling step, are well known to the skilled person and will not be described in detail.

After forming the injection and the delivery walls 3, 4, the delivery wall 4 is placed in a bottom cavity of a housing element of a sealing station. This housing element is configured for housing at least partially the sealing portions 4*a* of the injection wall and more preferably the entire delivery wall 4.

The delivery wall 4 is preferably maintained in place in said housing element by applying on its external surface a light attraction force directed towards said bottom cavity (for example using light vacuum).

According to a first sealing mode the housing element is preferably preheated at a temperature (Th) which is preferably between 40° C. and 100° C., more preferably between 60° C. and 70° C., before the sealing begins.

The compacted ingredient body 2 is then placed inside the delivery wall 4 and then the injection wall 3 is positioned above the delivery wall 4 to form the container chamber 1 (as shown in FIGS. 1 and 3). Then the two superposed sealing portions 4A, 3A of the two walls 3, 4 are sealed together. Preferably, the sealing station comprise also a movable sealing head which reaches, very locally, a sealing temperature between 130° C. and 200° C., more preferably between 160° C. and 180° C.

According to a second sealing mode the housing element is not heated, and the sealing occurs by using a movable ultrasound sealing head, of the type usual for the skilled person.

Once the container is sealed, it is preferably, rapidly moved to the cooling station.

The temperature to which the pod is cooled after the sealing step, can be set either:

between −10° C. and +25° C., or alternatively, such that it is at least 15° C. lower than the housing temperature (Th), preferably said cooling temperature (Tc) is at least 20° C. lower than the housing temperature (Th).

It should be understood that various changes and modifications to the presently preferred embodiment of the container and the process for producing a container, described herein will be apparent to those skilled in the art. Such changes and modifications can be made without departing from the scope of the present invention covered by the appended claims. For example, the injection and/or the delivery walls 3, 4, and or the body 2 formed by the compacted ingredient, may have a different shape.

The invention claimed is:

1. A process for producing a container for the preparation of a beverage in a beverage preparation device, comprising the steps of:

a. providing an injection wall of said container, comprising a paper layer through which water is to be introduced in the container, wherein said injection wall is able to be punctured by an injection member of the beverage preparation device for circulating water under pressure inside said container, b. providing a beverage delivery wall of said container, comprising a paper layer through which the beverage is to be dispensed out of the container, wherein said delivery wall is able to be opened by an opening member of the beverage preparation device, wherein at least one of said injection and delivery walls has a cup shape, c. placing a beverage ingredient in said at least one cup shaped wall, wherein said beverage ingredient is a body formed by a compacted beverage ingredient, d. sealing together edge portions of said injection and delivery walls in a sealing station, such as to form a chamber in which said body formed by a compacted beverage ingredient is stored, wherein said sealing station comprises a housing element for housing at least partially said injection and/or delivery walls and wherein said housing element at the beginning of the sealing has a housing temperature (Th), and wherein said body is shaped and dimensioned such as not to completely fill said chamber;

after the sealing step, the container is cooled at a cooling temperature (Tc), being either:

at least 15° C. lower than the temperature of the housing, or comprised between −10° C. and +25° C., to reduce the space not filled by the body in the chamber and to increase the area of the internal surface of at least the delivery wall which adheres to the body of the compacted beverage ingredient.

2. A process as claimed in claim 1, wherein the duration of the cooling is at least 0.5 second.

3. A process as claimed in claim 1, wherein the housing temperature (Th) is between 40° C. and 100° C.

4. A process as claimed in claim 1, wherein the container is cooled with a cooling gas.

5. A process as claimed in claim 1, wherein the cooling step starts within 0.1 second and 60 seconds.

6. A container for the preparation of a beverage in a beverage preparation device comprising a chamber in which a beverage ingredient is stored, said chamber comprising:

an injection wall, through which a fluid is to be introduced in the container, wherein said injection wall is configured to be punctured by an injection member of the beverage preparation device for circulating said fluid under pressure inside said chamber, and a beverage delivery wall, through which the beverage is to be dispensed out of the container, wherein said beverage delivery wall is configured to be opened upon interaction with opening elements of the beverage preparation device under the effect of rising pressure of said fluid being injected into said chamber;

wherein the injection and the delivery walls comprise sealing portions for sealingly connecting said injection and the delivery walls together;

wherein the injection and delivery walls form an oxygen barrier for the beverage ingredient stored in said chamber;

wherein the beverage ingredient is a body formed by a compacted ingredient, having a three-dimensional shape and being dimensioned such as not to completely fill the chamber, and in such a way that at least one empty space is provided in the chamber between said body and the internal surfaces of the injection and delivery walls;

wherein the injection and delivery walls comprise a paper layer, the empty space inside said chamber is less than 5% of the total volume of said chamber;

and in that the inner surface of at least said delivery wall is continuously in contact with the outer surface of the beverage ingredient body except for a terminal portion of said injection and delivery walls located at the sealing portions.

7. A container according to claim 6, wherein the paper layer of the injection and delivery walls has a feature selected from the group consisting of:

i) it is made of a sulfurized paper, having intrinsic oxygen barrier features;

ii) it is a formable paper layer, which can be stretched and deformed for obtaining a requested shape; and iii) it has a weight comprised between 50 $g/m^2$ and 200 $g/m^2$.

8. A container according to claim 6, wherein the injection and the delivery walls have a cup shape that the injection and delivery walls have the same shape and dimensions, and that the beverage ingredient body has a three-dimensional shape, substantially identical to the shape of the chamber delimited by the injection and the delivery walls.

9. A container according to claim 6, wherein the injection and delivery walls are made of home compostable materials.

* * * * *